United States Patent [19]

Winslow

[11] 3,963,076

[45] June 15, 1976

[54] METHOD AND APPARATUS FOR GRAVEL PACKING WELL BORES

[75] Inventor: Larry K. Winslow, Edmond, Okla.

[73] Assignee: Baker Oil Tools, Inc., Los Angeles, Calif.

[22] Filed: Mar. 7, 1975

[21] Appl. No.: 556,099

[52] U.S. Cl. ..... 166/278; 166/51; 166/226

[51] Int. Cl.[2] ..... E21B 43/04; E21B 43/10

[58] Field of Search ..... 166/278, 276, 51, 124, 166/126, 131, 205, 226, 307, 312, 315

[56] References Cited

UNITED STATES PATENTS

| | | | |
|---|---|---|---|
| 3,329,205 | 7/1967 | Brown | 166/278 |
| 3,421,586 | 1/1969 | Solum | 166/51 |
| 3,627,046 | 12/1971 | Miller et al. | 166/278 |
| 3,710,862 | 1/1973 | Young et al. | 166/278 |
| 3,726,343 | 4/1973 | Davis, Jr. | 166/278 |
| 3,818,986 | 6/1974 | Abney et al. | 166/278 X |
| 3,830,294 | 8/1974 | Swanson, Jr. | 166/278 X |
| 3,850,246 | 11/1974 | Despujols | 166/278 |

*Primary Examiner*—Stephen J. Novosad
*Attorney, Agent, or Firm*—Bernard Kriegel

[57] ABSTRACT

A liner provided with by-pass ports and a perforated portion or screen below the ports is secured to a suitable well packer and lowered on an outer tubing string in well casing to a location at which the screen straddles casing perforations within a producing formation, the packer being packed-off against the casing above its perforations and anchored against movement in both directions to secure the liner and its screen in place. An inner tubing string is lowered through the outer string into the liner, the inner string and liner having upper and lower seal devices, either of which is selectively engaged while the other is disengaged, or both of which are disengaged, by longitudinal movement of the inner string in the outer string and liner, to control the flow of circulating, washing, or acidizing fluids in both directions between the inner string, liner-casing annulus, and inner string-outer string annulus, and also the placement of gravel in the liner-casing annulus.

19 Claims, 5 Drawing Figures

35
14
W
12
16
20
C
24
30
50
25
23
44
35
22
27
26
28
29
36a
31
37
45
39
36
11a
21
38
36a
11
P
48
46
Z
42
41
58
60
10
53
51
57
56
52
59
B
13
19
G
54
62
61
55
15
~14~
~16~
40

METHOD AND APPARATUS FOR GRAVEL PACKING WELL BORES

The present invention relates to a method and apparatus for gravel packing a well bore to prevent sand from flowing from a producing formation into the well bore, which would greatly reduce or stop the flow of formation fluids into the well.

In gravel packing a high pressure well initially held under control by drilling mud in the well, a liner embodying a perforated portion or screen has been suspended from a well packer set in the well above the production zone, the screen being disposed within the production zone. The region in the well around the screen is cleaned out to remove the mud therefrom, which is replaced with clean fluid. To avoid the necessity for removing all of the drilling mud from the well, two circulation paths extending to the top of the well have been provided, which enable the mud in the well above the packer and around the circulation paths to remain in place. One of the circulation paths is used for pumping fluid or gravel down the well, the other being used for conducting return fluids to the top of the well. In the applications of John R. Barbee, Jr. et. al., for "Method and Apparatus for Gravel Packing", Ser. No. 480,737, filed June 19, 1974, now U.S. Pat. No. 3,913,676, and Dewitt L. Fortenberry, for "Method and Apparatus for Packing Gravel in a Subterranean Well", Ser. No. 480,743, filed June 19, 1974, and now U.S. Pat. No. 3,901,308, a liner provided with a perforated or screen section or sections has been supported from a dual string well packet set in a well above the production zone, with two parallel tubing strings connected to the packer and extending to the top of the well. One of the parallel tubing strings communicates with the interior of the liner and its screen, while the other tubular string communicates with the well annulus around the liner and screen, thereby providing two separate circulation paths isolated from the drilling mud above the packer. Fluids can flow through the paths in removing the mud in the well below the packer without circulating it through the liner screen, squeezing acid and gravel into the producing zone, depositing the gravel around the screen, and washing the inside of the liner and screen after the gravel packing operation has been completed.

Another method and apparatus for gravel packing is illustrated in the application of Rudy B. Callihan et. al., for "Gravel Packing Apparatus and Method", Ser. No. 227,558, filed Feb. 17, 1972, which utilizes a well packer supporting a liner and screen, with a single tubular string extending to the top of the well. One flow path is provided by the tubing string, but the other flow path includes the annulus above the packer between the tubing string and the well casing in which the packer is set. The apparatus includes a cross-over arrangement which, by selectively reversing the direction of circulation in the tubing string and annulus, in conjunction with longitudinal movement of the tubing string, enables the removal of the drilling mud from the well, acidizing and otherwise conditioning the well, placing gravel around the screen, and cleaning out the interior of the liner and screen.

The cross-over apparatus has the advantage of confining the high pressure required for effectively acidizing the well and for squeezing gravel into the production zone to the tubing string, but it has the disadvantage of having relatively small diameter passage portions in the cross-over regions, which can prevent adequate circulation of fluid and which might plug while displacing gravel through them.

By virtue of the present invention, a single string packer is used for supporting the liner and screen, instead of a dual string packer and side-by-side or parallel tubing strings, but the advantages of the dual packer arrangement are retained. Moreover, the cross-over feature of application Ser. No. 227,558 and its disadvantages are eliminated while retaining the advantage of confining the high pressures for acidizing and squeezing gravel to a relatively small diameter tubing string, which, however, is sufficiently large in diameter for properly performing the complete gravel packing operation, without danger of plugging.

With the present invention, the well packer with the liner and its perforated portion or screen suspended therefrom is lowered on an outer tubing string in the well and the packer set in well casing above casing perforations within the formation producing zone, and with the screen straddling the perforations. After the packer is set, an inner tubular string is lowered through the outer string into the liner and its screen. Through appropriate manipulation of the inner string, flow in both directions can be selectively controlled through the inner string, the annulus around the liner and the annulus between the strings, to enable drilling mud in the well to be removed from the interior of the inner string, the annulus around the liner, as well as the annulus between the inner and outer strings. This is accomplished without removing the mud in the well around the outer string above the packer. Appropriate acidizing of the producing zone and the screen can be performed, as well as the pumping of gravel through the inner and outer tubing annulus and its depositing around the screen. Foreign substances, including small gravel particles, can also be cleaned from the interior of the liner and screen. Thereafter, the inner string can be pulled from the well, the outer string remaining in place, enabling the well production to flow through the screen into the liner and through the outer string to the top of the well.

This invention possesses many other advantages and has other purposes which may be made more clearly apparent from a consideration of a form and method embodying the invention. This form and method are shown and described in the present specification and in the drawings accompanying and constituting a part thereof. They will now be described in detail, for the purpose of illustrating the general principles of the invention; but it is to be understood that such detailed description is not to be taken in a limiting sense.

Referring to the drawings:

FIGS. 1*a* and 1*b* together constitute a side elevational and longitudinal sectional view through a gravel packing apparatus embodying the invention and disposed in a cased well, portions of the apparatus being illustrated in somewhat diagrammatic form, the parts being disposed in one relative position, FIG. 1*b* being a lower continuation of FIG. 1*a;*

Figure 1A:
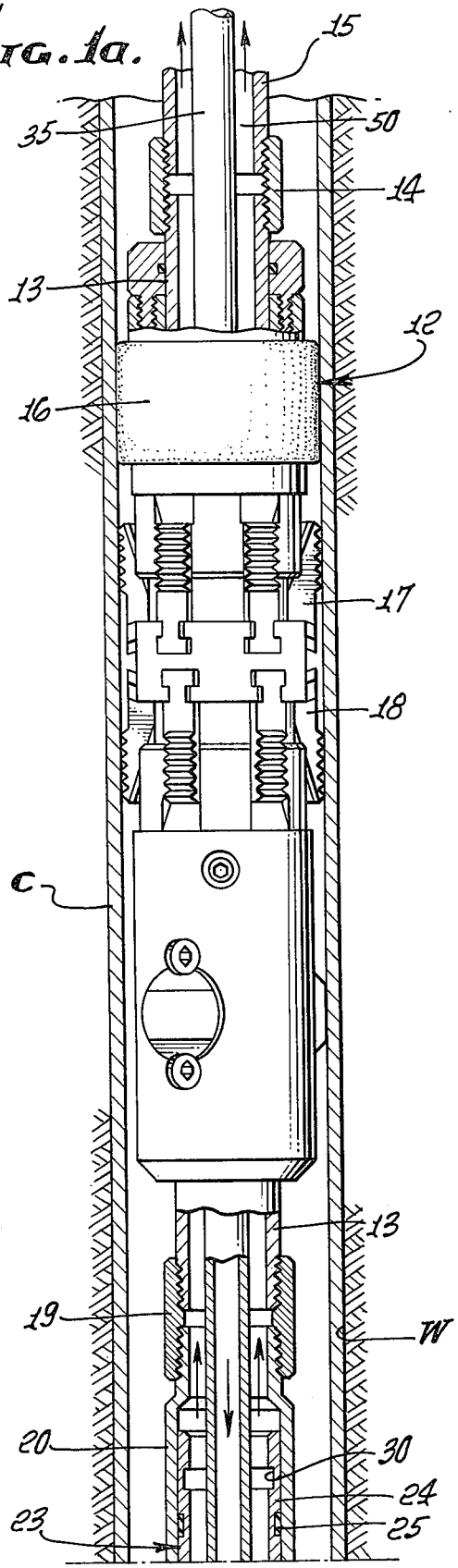

The apparatus disclosed in the drawings is used within a well bore W extending through a formation producing zone Z, a casing C having been suitably cemented or otherwise secured in place within the well bore. The casing has perforations P through which fluids from the producing zone can flow to the interior of the casing. A suitable bridge plug B is disclosed as having been set in the well casing a predetermined distance below the perforations, which serves to prevent fluid from the zone from flowing downwardly beyond the bridge plug, and which also acts as a locator for appropriately positioning a liner assembly 10 embodying one or more perforated portions or screens 11 with respect to the casing perforations.

The upper end of the liner assembly is secured to a suitable well packer 12, which may be of the retrievable type, and which can be anchored in packed-off condition in the well casing above the perforations P against movement in both longitudinal directions. The well packer specifically illustrated is of the retrievable type, being disclosed in U.S. Pat. No. 3,507,327. As shown in FIG. 1*a*, it contains an elongate body 13, the upper end of which is threadedly secured to a coupling 14, which is, in turn, threadedly secured to an outer tubular string 15 extending to the top of the well bore. The packer has a pliant, elastic packing 16 thereon for sealing against the inner wall of the well casing C, and also upper and lower slips 17, 18 expandable into gripping engagement with the wall of the well casing to anchor the packer thereto against movement in both upward and downward directions. Details of the specific well packer employed are not important to an understanding of the invention and can be found in the above-identified U.S. patent.

The lower end of the tubular packer body 13 is threadedly secured to a coupling 19, which is, in turn, threadedly secured to the upper valve body portion 20 of the liner assembly 10, which has a lower perforated or slotted screen portion 11 disposed within the perforations P when the lower end of the liner assembly rests upon the bridge plug B. A telltale screen portion 11*a* is spaced from the main screen or perforated portion 11 by a blank liner section 21. The valve body portion 20 has a plurality of side ports 22 initially in opened condition, but which may be closed by a sliding valve sleeve 23 having an upper imperforate portion 24 provided with longitudinally spaced elastomer seals 25 thereon engaging the inner wall of the valve body. When the ports 22 are open, the valve sleeve is held in an upper position by latch arms 26 formed thereon by circumferentially spaced longitudinal slots 27, these arms terminating in lower tapered cam fingers 28 received in an upper internal groove 29 in the valve body, to retain the valve sleeve in its upper position, and with both seals 25 disposed above the ports 22.

Figures 2, 3, 4:
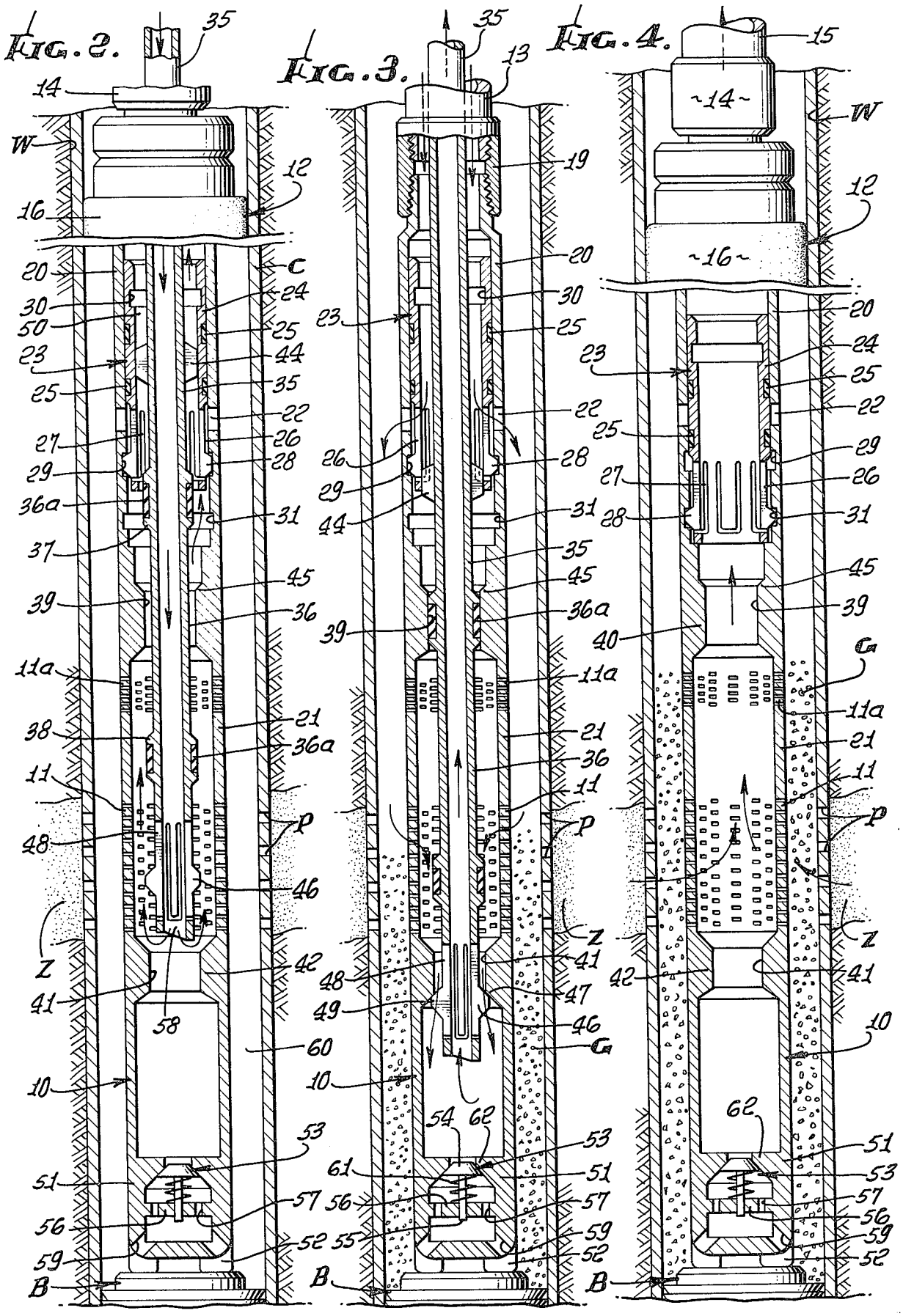
FIG. 2 is a view corresponding to FIGS. 1*a* and 1*b*, with certain parts shifted to another relative position.
FIG. 3 is a view similar to FIG. 2, with the parts disposed in another relative position.
FIG. 4 is a view similar to FIGS. 2 and 3, with gravel deposited around the screen of the liner and with the inner tubing string removed from the well.

The valve sleeve 23 can be shifted downwardly in the valve body to a port closing position, as disclosed in FIG. 4, through use of a suitable and known shifting tool (not shown), which can engage the sleeve within an internal groove 30 in the upper portion of the sleeve, and impart a downward force on the sleeve to effect an inward camming action on the fingers 28 out of the upper groove 29, permitting the sleeve to shift downwardly to a lower position in which its spaced seals 25 straddle the ports 22, the fingers then springing outwardly into a lower valve body groove 31 to retain the sleeve in the position closing the ports (FIG. 4). The details of the upper valve and its sleeve form no part of the present invention. They are disclosed in U.S. Pat. No. 3,355,142. Any suitable type of valve mechanism for controlling the passage of fluid through the ports can be used in practicing the invention. A tool that can be used for shifting the valve 23 is disclosed in U.S. Pat. No. 3,335,802. Any other suitable type of shifting tool can be used.

The apparatus includes an inner tubular string 35 movable from the top of the well bore into and through the outer string 15 after the well packer has been anchored in packed-off condition in the well casing. The inner string includes a lower tubular mandrel section 36 which has an upper valve seal portion or head 37 larger in diameter than the main body portion of the mandrel, as well as a lower valve seal portion or head 38 appropriately longitudinally spaced from the upper portion, and which also has a larger diameter than the main portion of the mandrel. The upper seal portion is adapted to be located within a cylindrical valve seat 39 in an upper seal receptacle 40 within the liner above its upper telltale screen 11*a*, whereas, the lower seal portion 38 is adapted to be disposed and sealed within a lower cylindrical valve seat 41 formed in a lower seal receptacle 42 below the main screen or perforated portion 11 of the liner assembly. The upper and lower valve portions preferably include elastomer seals 36*a* thereon to effect leakproof seals with the cylindrical seats 39, 41 when the valve portions 37, 38 are engaged therewith.

Figure 1B:
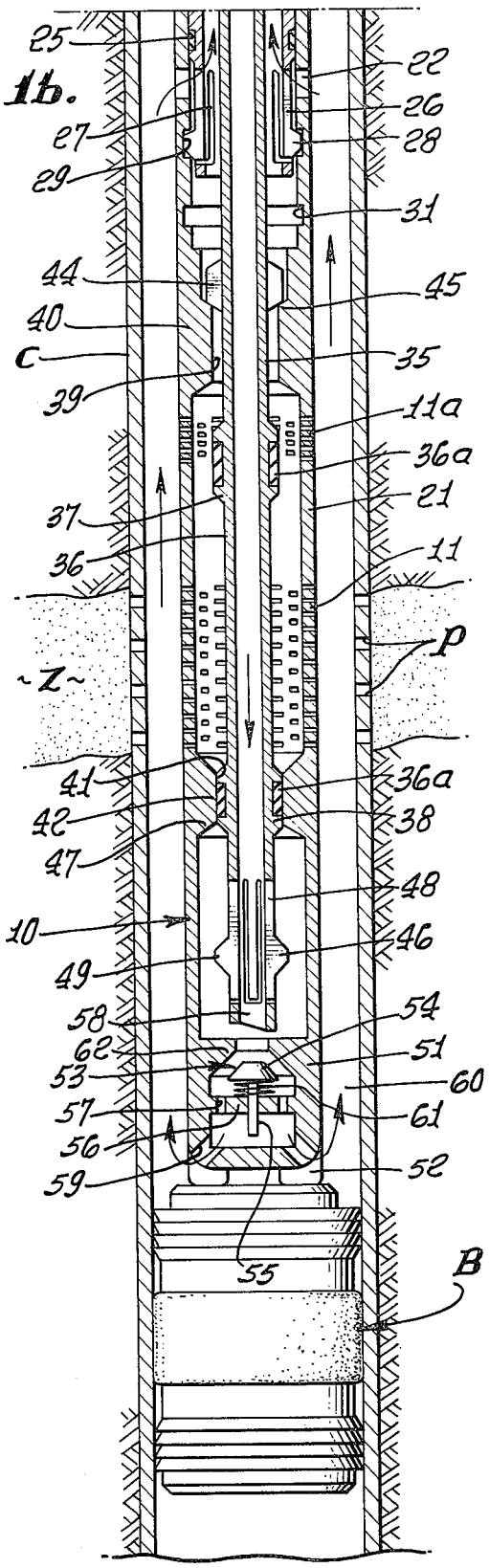

The upper and lower valve portions 37, 38 are spaced from one another by such a distance that the lower portion 38 sealingly engages the lower cylindrical seat 41, with the upper valve portion 37 disengaged from its cylindrical seat 39, as disclosed in FIG. 1*b*, or the upper valve portion 37 is sealingly engaged within its upper seat 39 while the lower valve portion 38 is disposed above its lower cylindrical seat 41, as disclosed in FIG. 3. The first position is determined by providing a suitable upper locator on the mandrel, which may be constituted as a spider having circumferentially spaced ribs 44 that move into engagement with a seat or stop 45 on the upper receptacle 40. The second position of the mandrel 36 is determined by the engagement of a lower locator 46, in the form of a collet, with the lower end 47 of the lower receptacle 42, such as disclosed in FIG. 3. This lower locator includes circumferentially spaced arms 48 having outer tapered cam projections 49 which engage the lower end of the lower seal receptacle. These arms 48 can spring inwardly upon the taking of a sufficient upward pull on the inner string 35 and mandrel 36, the tapered outer portions on the tapered projections being cammed or deflected inwardly by the lower tapered surface 47 of the seal receptacle, to permit the entire mandrel to be shifted upwardly to the position illustrated in FIG. 2, in which both the upper and lower valve members 37, 38 are disengaged from their companion seats, permitting fluids to flow from the interior of the inner string 35 to the lower end of the mandrel 36, and thence upwardly around the mandrel along the screen portions 11, 11*a* and back into the annular space 50 between the mandrel and liner and between the inner and outer tubular strings. If desired, the mandrel can be shifted from its FIG. 2 position back to its FIG. 3 or FIG. 1*b* position by lowering the inner tubular string 35 and mandrel 36, the collet locator 46 snapping through the lower receptacle 42 and its cylindrical seat 41 to a position below the lower receptacle.

The lower portion of the liner assembly 10, as specifically illustrated, is constituted as a liner shoe 51 having ribs 52 adapted to rest upon the upper end of the bridge plug B. This shoe has an upwardly closing one-way valve 53 therein provided by a valve head 54 from which a stem 55 depends, the stem being slidable within a spider 56 having longitudinal ports 57 therein. Fluid from within the liner assembly above the shoe can pass downwardly through an open passage 58 and around the valve head 54 and through the ports 57, discharging through lower ports 59 in the shoe into the annular space 60 between the liner assembly 10 and casing C. In the event that fluid tends to flow in the reverse direction, the fluid itself, as well as a helical spring 61 surrounding the stem 55, will shift the valve head 54 upwardly into engagement with a companion valve seat 62 to close the valve and preclude such reverse flow of fluid. In other words, fluid can flow downwardly through the shoe 51, but cannot flow upwardly therethrough.

In the performance of a gravel packing operation with the apparatus illustrated in the drawings, the well bore is usually full of drilling mud. The bridge plug B is lowered and set at its predetermined location in the casing C below the casing perforations P. The liner assembly 10, with its lower screen or perforated portion 11 and upper telltale screen 11*a* spaced therefrom, is secured to the lower end of the packer body 13 and the outer tubular string 15 secured to the upper end of the packer body, enabling the liner assembly and packer to be lowered as a unit through the well casing until the liner shoe 51 engages the bridge plug. The packer 12 is then anchored in packed-off condition in the casing, thereby properly locating the perforated or slotted screen 11 and the upper telltale screen 11*a* in position. The valve body ports 22, at this time, are in the open position, as illustrated in FIGS. 1*b*, 2 and 3.

The inner string of tubing 35, with the tubular mandrel 36 constituting its lower portion, is then lowered into the outer tubular string 15 until the upper spider 44 lands upon the upper seal receptacle 40, which will effect a seal between the lower valve member 38 and the cylindrical seat 41 of the lower receptacle 42, the upper valve member 37 being disposed below the upper seal receptacle 40. If desired, the inner tubular string can have a sufficiently small diameter as to enable it to be fed progressively from a reel at the top of the well bore to its ultimate position disclosed in FIG. 1*b*. Suitable circulating fluid can now be pumped down the inner tubular string 35, which will discharge from the lower open end 58 of the mandrel, unseating the one-way valve 53 and flowing outwardly into the annular space 60 between the liner and casing, the flow continuing through the valve ports 22 into the annular space 50 between the inner and outer tubular strings. In this manner, all of the drilling mud can be displaced from the inner string 35, liner-casing annulus 60, and inner tubing-outer tubing annulus 50 to the top of the well bore.

The inner tubular string can then be elevated to locate the mandrel in the position disclosed in FIG. 2, which enables the mud within the liner assembly and its screen portions 11, 11*a* to be displaced upwardly through the annulus 50 between the inner and outer strings to the top of the well bore. Thereafter, acid can be pumped down the tubing string 35 into the interior of the liner and its screen portions.

The inner tubular string is relowered to the location disclosed in FIG. 1*b*, and acid pumped down through the mandrel 36 and into the annulus 60 between the liner and well casing. The inner tubular string is then elevated a short distance to the position illustrated in FIG. 3, in which the upper valve 37 is engaged within its seat 39, which permits the acid to be washed back and forth through the screens by alternately pumping fluid down through the inner tubular string and down through the inner-outer tubular string annulus 50. Thereafter, a surface valve (not shown) at the top of the well and controlling the inner-outer tubing annulus is closed, enabling the acid to be squeezed through the perforations P into the formation producing zone Z. With the mandrel remaining in the FIG. 3 position, the desired quantity of gravel G is then pumped down the inner-outer tubing annulus 50, the gravel passing through the valve ports 22 and into the liner-casing annulus 60, the liquid returns flowing through the screens 11, 11*a* and into the mandrel 36 and upwardly through the inner tubing string 35 to the top of the well. When the gravel rises in the annulus 60 to a position substantially covering or above the telltale screen 11*a*, the rise in pressure at the top of the well advises the operator that sufficient gravel has been deposited in the annulus. A squeeze pressure can then be placed on the gravel to force it through the perforations P into the formation.

If desired, the inner tubing string 35 can again be placed in the position disclosed in FIG. 2, and the inside of the liner assembly 10, including its screen portions 11, 11*a*, washed by pumping down the inner string and upwardly around the string and through the inner and outer tubing annulus 50 to the top of the well.

The inner string 35 can now be snubbed out of the well, and the well put on production, the production passing through the gravel pack G and the screens 11, 11*a* to the interior of the liner assembly and upwardly through the outer tubular string 15 to the top of the well. Before being placed on production, the valve sleeve 23 is shifted downwardly to its position closing the ports 22, as disclosed in FIG. 4.

I claim:

1. Apparatus for use in a subterranean well having a production zone and a packer set in the well above the zone comprising: a tubular liner assembly adapted to depend from the packer within the production zone and to communicate with an outer tubular string operatively associated with the packer and extending to the top of the well, said liner assembly including a tubular portion having perforations through which fluids can flow to the interior of said assembly, said assembly having an upper passage through which fluent material can flow between the interiors of the outer tubular string and liner assembly to the exterior of said liner assembly below the packer, said assembly further having a lower passage through which fluids can flow between the interior and exterior of said assembly, an inner tubular member within said liner assembly adapted for connection to an inner tubular string extending through the outer tubular string to the top of the well, said inner tubular member being communicable with the interior of said assembly, and with said lower passage, said inner tubular member defining an annular space with said assembly communicable with the annular space between the inner and outer tubular strings, and valve means for selectively controlling fluid flow between said inner tubular member and tubular portion, said inner tubular member and lower passage, and said inner tubular member and annular space between the tubular strings.

2. Apparatus as defined in claim 1; said valve means comprising an upper valve seat in said assembly, a lower valve seat in said assembly longitudinally spaced below said upper seat, and upper and lower longitudinally spaced valve heads on said inner tubular member sealingly engageable with said upper and lower seats, respectively, said tubular member being longitudinally shiftable in said assembly to selectively engage said lower head with said lower seat or said upper head with said upper seat.

3. Apparatus as defined in claim 2; and coengageable locator means on said inner tubular member and liner assembly to locate said upper head in sealed engagement with said upper seat or said lower head in sealed engagement with said lower seat.

4. Apparatus as defined in claim 2; said valve seats being cylindrical valve seats.

5. Apparatus as defined in claim 2; coengageable upper locator means on said inner tubular member and liner assembly to locate said lower head in said lower seat; and coengageable lower locator means on said inner tubular member and liner assembly to locate said upper head in said upper seat.

6. Apparatus as defined in claim 5; said lower locator means on said inner tubular member comprising laterally movable elements adapted to be deflected laterally inwardly for passage through said lower seat in response to elevation of said tubular member in said assembly to place said upper and lower valve heads in positions in which they are both disengaged from their respective upper and lower seats.

7. Apparatus as defined in claim 1; said valve means comprising an upper valve seat in said assembly, a lower valve seat in said assembly longitudinally spaced below said upper seat, and upper and lower longitudinally spaced valve heads on said inner tubular member sealingly engageable with said upper and lower seats, respectively, said tubular member being longitudinally shiftable in said assembly to selectively engage said lower head with said lower seat or said upper head with said upper seat; said tubular member being shiftable longitudinally in said assembly to a position in which said heads are disengaged from both seats at the same time.

8. Apparatus as defined in claim 1; and one-way valve means on said assembly closing said lower passage to prevent upward flow of fluid therethrough and opening said lower passage to permit downward flow of fluid therethrough.

9. Apparatus as defined in claim 1; and valve means on said assembly shiftable from a position in which said upper passage is open to a position closing said upper passage.

10. Apparatus for gravel packing a production zone in a subterranean well comprising: a packer adapted to be set in the well above the zone, a tubular liner assembly secured to and depending from the packer and adapted to be disposed within the production zone and to communicate with an outer tubular string operatively associated with the packer and extending to the top of the well, said liner assembly including a tubular portion having perforations through which fluids can flow to the interior of said assembly, said assembly having an upper passage through which fluent material can flow between the interiors of the outer tubular string and liner assembly to the exterior of said liner assembly below said packer, said assembly further having a lower passage through which fluids can flow between the interior and exterior of said assembly, an inner tubular member within said liner assembly and packer and adapted for connection to an inner tubular string extending through the outer tubular string to the top of the well, said inner tubular member being communicable with the interior of said assembly, said lower passage and with the interior of said tubular portion, said inner tubular member defining an annular space with said assembly and packer and communicable with the annular space between the inner and outer tubular strings, and valve means for selectively controlling fluid flow between said inner tubular member and tubular portion, said inner tubular member and lower passage, and said inner tubular member and annular space between the tubular strings.

11. Apparatus as defined in claim 10; said valve means comprising an upper valve seat in said assembly, a lower valve seat in said assembly longitudinally spaced below said upper seat, and upper and lower longitudinally spaced valve heads on said inner tubular member sealingly engageable with said upper and lower seats, respectively, said tubular member being longitudinally shiftable in said assembly to selectively engage said lower head with said lower seat or said upper head with said upper seat; said tubular member being shiftable longitudinally in said assembly to a position in which said heads are disengaged from both seats at the same time.

12. Apparatus as defined in claim 11; and coengageable locator means on said inner tubular member and liner assembly to locate said upper head in sealed engagement with said upper seat or said lowere lower in sealed engagement with said lower seat.

13. Apparatus as defined in claim 11; said lower locator means on said inner tubular member comprising laterally movable elements adapted to be deflected laterally inwardly for passage through said lower seat in response to elevation of said tubular member in said assembly to place said upper and lower valve heads in positions in which they are both disengaged from their respective upper and lower seats.

14. Apparatus for gravel packing a production zone in a subterranean well comprising: a packer adapted to be set in the well above the zone, a tubular liner assembly secured to and depending from the packer and adapted to be disposed within the production zone, an outer tubular string connected to the packer and extending to the top of the well, said liner assembly including a tubular portion having perforations through which fluids can flow to the interior of said assembly, said assembly having an upper passage through which fluent material can flow between the interiors of said outer tubular string and liner assembly to the exteriors of said liner assembly below the packer, said assembly further having a lower passage through which fluids can flow between the interior and exterior of said assembly, an inner tubular member within said liner assembly and packer, an inner tubular string connected to said inner tubular member and extending through said outer tubular member to the top of the well, said inner tubular member being communicable with the interior of said assembly, said lower passage, and with the interior of said tubular portion, said inner tubular member defining an annular space with said assembly and packer and communicable with the annular space between said inner and outer tubular strings, and valve means for selectively controlling fluid flow between said inner tubular member and tubular portion, said inner tubular member and lower passage, and said inner tubular member and annular space between said tubular strings.

15. A method of gravel packing a production zone in a subterranean well comprising the steps of lowering a liner assembly provided with a perforated portion on a packer in the well to locate the perforated portion of said liner assembly within the production zone, setting the packer in the well above the production zone, operatively connecting an outer tubular string to the packer with the string extending to the top of the well, lowering an inner tubular string having a lower tubular member within the outer string, with said inner tubular string extending to the top of the well, to position the tubular member within the liner assembly and to provide a first annular space between said strings communicable with a second annular space between said tubular member and said liner assembly and packer, said liner assembly having an upper passage above said perforated portion establishing communication between said second annular space and the exterior of said liner assembly below said packer, circulating fluid downwardly through one of the tubular strings into the region of the well below said packing and surrounding the liner assembly for upward flow through the other of the tubular strings to the top of the well, and pumping gravel down one of the tubular strings into the well surrounding the liner assembly to fill the annular space around the perforated portion of the liner assembly.

16. A method of gravel packing a production zone in a subterranean well comprising the steps of lowering a liner assembly provided with a perforated portion on a packer in the well to locate the perforated portion of said liner assembly within the production zone, setting the packer in the well above the production zone, operatively connecting an outer tubular string to the packer with the string extending to the top of the well, lowering an inner tubular string having a lower tubular member within the outer string to position the tubular member within the liner assembly and to provide a first annular space between said strings communicable with a second annular space between said tubular member and said liner assembly and packer, said liner assembly having an upper passage above said perforated portion establishing communication between said second annular space and the exterior of said liner assembly below said packer, circulating fluid downwardly through one of the tubular strings into the region of the well below said packing and surrounding the liner assembly for upward flow through the other of the tubular strings to the top of the well, and pumping gravel down one of the tubular strings into the well surrounding the liner assembly to fill the annular space around the perforated portion of the liner assembly; effecting a first seal between the exterior of said tubular member and said liner assembly below said perforated portion to confine the flow of circulating fluid along the entire external length of said perforated portion.

17. A method as defined in claim 16; shifting said inner string and tubular member longitudinally in the well to open said first seal and provide a second seal between the exterior of said tubular member and said liner assembly above said perforated region, said gravel being pumped from the top of the well through said first annular space and upper passage into said annular space around said perforated portion with said second seal effective, the fluid in advance of the gravel flowing into and through said inner string and toward the top of the well.

18. A method as defined in claim 16; prior to pumping gravel down said one of the tubular strings shifting said inner string and tubular member longitudinally in the well to open said first seal, pumping fluid down said inner string into said perforated portion for upward flow therethrough into said first annular space, longitudinally shifting said inner string and tubular member in the well to open said first seal and provide a second seal between the exterior of said tubular member and said liner assembly above said perforated region, said gravel then being pumped from the top of the well through said first annular space and upper passage into said annular space around said perforated region with said second seal effective, the fluid in advance of the gravel flowing into and through said inner string and toward the top of the well.

19. A method as defined in claim 18; withdrawing said inner string and lower tubular member through said outer string to the top of the well, and closing said upper passage.

* * * * *

UNITED STATES PATENT AND TRADEMARK OFFICE

CERTIFICATE OF CORRECTION

PATENT NO. : 3,963,076

DATED : June 15, 1976

INVENTOR(S) : LARRY K. WINSLOW

It is certified that error appears in the above-identified patent and that said Letters Patent are hereby corrected as shown below:

Column 1, line 32, "packet" should read -- packer --.

Column 8, line 35, cancel "lowere" before "lower" and insert -- head -- after "lower"

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*